US007007640B2

(12) United States Patent
Sakita

(10) Patent No.: US 7,007,640 B2
(45) Date of Patent: Mar. 7, 2006

(54) ENGINE WITH A VARIABLE COMPRESSION RATIO

(76) Inventor: Masami Sakita, P.O. Box 61089, Palo Alto, CA (US) 94306-1089

( * ) Notice: Subject to any disclaimer, the term of this patent is extended or adjusted under 35 U.S.C. 154(b) by 0 days.

(21) Appl. No.: 10/893,831

(22) Filed: Jul. 19, 2004

(65) Prior Publication Data

US 2005/0016476 A1 Jan. 27, 2005

Related U.S. Application Data

(60) Provisional application No. 60/513,391, filed on Oct. 22, 2003, provisional application No. 60/511,833, filed on Oct. 16, 2003, provisional application No. 60/490,083, filed on Jul. 25, 2003.

(51) Int. Cl.
*F02B 75/04* (2006.01)
*F02B 75/32* (2006.01)

(52) U.S. Cl. ..... 123/78 F; 123/197.4

(58) Field of Classification Search ..... 123/488, 123/78 F, 78 R, 48 R, 197.4
See application file for complete search history.

(56) References Cited

U.S. PATENT DOCUMENTS 4,998,511 A 3/1991 Van Avermaete
5,443,043 A 8/1995 Nilsson et al.
5,908,014 A 6/1999 Leighthinger
6,202,623 B1 3/2001 Ehrlich
6,247,430 B1 6/2001 Yapici
6,443,107 B1 * 9/2002 Mendler ..... 123/48 B
6,450,136 B1 9/2002 Klomp et al.
6,588,384 B1 7/2003 Yapici

* cited by examiner

*Primary Examiner*—Henry C. Yuen
*Assistant Examiner*—Hyder Ali

(57) ABSTRACT

The engine is equipped with a crankshaft that is rotatably connected to pistons through connecting rods, and a driveshaft, which is used as the means for outputting the torque produced by the engine. The variable compression ratio mechanism of the preferred embodiment includes at least one crankshaft-driveshaft arm assembly, at least one crankshaft support assembly, and at least one jackscrew assembly. The crankshaft-driveshaft arm assembly ensures that the axis of the crankshaft when it is lifted will follow a circular arc with a fixed radius that centers the rotational axis of the driveshaft. The crankshaft-driveshaft arm assemblies and the crankshaft support plate assemblies are connected together by metal plates. A transmission assembly transmits the torque from the crankshaft to the driveshaft. The jackscrew assembly lifts up and down the crankshaft, and it does not require a locking mechanism.

9 Claims, 18 Drawing Sheets

ENGINE WITH A VARIABLE COMPRESSION RATIO

DOMESTIC PRIORITY

This application is entitled to the benefit of provisional Applications: application No. 60/490,083 filed on Jul. 25, 2003; Application No. 60/511,833 filed on Oct. 16, 2003; and Application No. 60/513,391 filed on Oct. 22, 2003, all entitled "Engine with a Variable Compression Ratio."

FIELD OF THE INVENTION

This invention relates generally to an internal combustion engine that operates with a variable compression ratio.

BACKGROUND OF THE INVENTION

The concept of an internal combustion engine with a variable compression ratio (VCR) has existed for more than 100 years. Probably the earliest U.S. Patent on a VCR was No. 651,966 by Fleury, issued in 1900. Since then, over 70 U.S. Patents have been issued on engines with VCR systems or on VCR mechanisms. In 2000, Saab displayed the SVC (Saab variable compression) engine in the Geneva auto show, and since then VCR has attracted enormous attention.

The VCR engine displayed by Saab divides the engine into two parts—engine head and crankcase section (U.S. Pat. No. 5,443,043 by Nilsson et al.). The engine head includes the piston cylinder block, and the crankcase includes a crankshaft. The engine is capable of tilting its head while keeping the crankcase straight up. Tilting of the head causes a change in cylinder volume, but the change in cylinder volume is most pronounced when the volume is minimum, and thus the compression ratio changes.

A VCR engine of different design by Ehrlich (U.S. Pat. No. 6,202,623 B1) uses modified crank pin design. In Ehrlich's engine, the metal member that is used as a bearing of the crank pin has two holes (one for the connecting rod pin bearing and the other for the crank pin bearing) and the trajectory of the rotational axis of the crank pin can be changed by a handle that is affixed to the metal member that holds the crank pin bearing.

A VCR engine of another design by Yapici (U.S. Pat. No. 6,588,384) uses eccentric rings that support the crankshaft. The crankshaft can be moved up and down by rotating the eccentric rings. The engine's rotational force is outputted through concentric inner gear affixed to the flywheel. The invention by Yapici teaches that an engine equipped with his VCR mechanism does not require significant modification of the engine.

These VCR mechanisms, however, have weaknesses also. In the engine invented by Nilsson et al., the connection of the engine with the exhaust system must be made flexible enough to absorb the continuous movement of the engine if the exhaust system is kept stationary. In the engine invented by Ehrlich, the VCR mechanism adds extra inertia and friction-causing parts, and thus frictional loss must increase, especially at high-speed operation. In the engine by Yapici, the spur gear teeth of the eccentric rings must bear the force due to the reciprocating movements of the piston.

OBJECTS OF THE INVENTION

An object of this invention is the provision of a VCR engine that does not cause movement of the engine head while the VCR mechanism is in operation.

An object of this invention is the provision of a VCR mechanism that has locking capability on an on-line, real-time basis.

An object of this invention is the provision of a VCR mechanism that does not excessively stress the engine frame.

An object of this invention is the provision of a VCR engine that is capable of changing compression ratio on-line real time by an on-board computer, or off-line manually.

SUMMARY OF THE INVENTION

The engine of the present invention is equipped with a mechanism that enables VCR operation. The engine has a driveshaft through which the engine's output is transmitted to the (externally located) transmission, and a crankshaft that functions generally in the same manner as the crankshaft of any reciprocating engine except that its output must be transmitted to the driveshaft. The rotational axis of the driveshaft is parallel to the rotational axis of the crankshaft. The VCR mechanism comprises a crankshaft-driveshaft arm assembly, a means to lift the crankshaft up and down and a transmission assembly.

The crankshaft-driveshaft arm assembly is a piece of metal to which a bearing that holds the crankshaft and another bearing that holds the driveshaft are affixed. One crankshaft-driveshaft arm assembly is employed at the longitudinally front-end, and another crankshaft-driveshaft arm assembly is employed at the longitudinally rear-end of the crankshaft. Thus, when the crankshaft is lifted or lowered, the crankshaft will only move around the driveshaft with a fixed radius. The means to lift up and down the crankshaft of the preferred embodiment of this invention includes the jackscrew assemblies. The transmission assembly, which is generally a set of gears, transmits rotational movements of the crankshaft to the driveshaft.

BRIEF DESCRIPTION OF THE DRAWINGS

The above description and other objects and advantages of this invention will become more clearly understood from the following description when considered with the accompanying drawings. It should be understood that the drawings are for purposes of illustration only and not by way of limitation of the invention. In the drawings, like reference characters refer to the same parts in the several views.

DETAILED DESCRIPTION OF THE INVENTION

Figure 1:
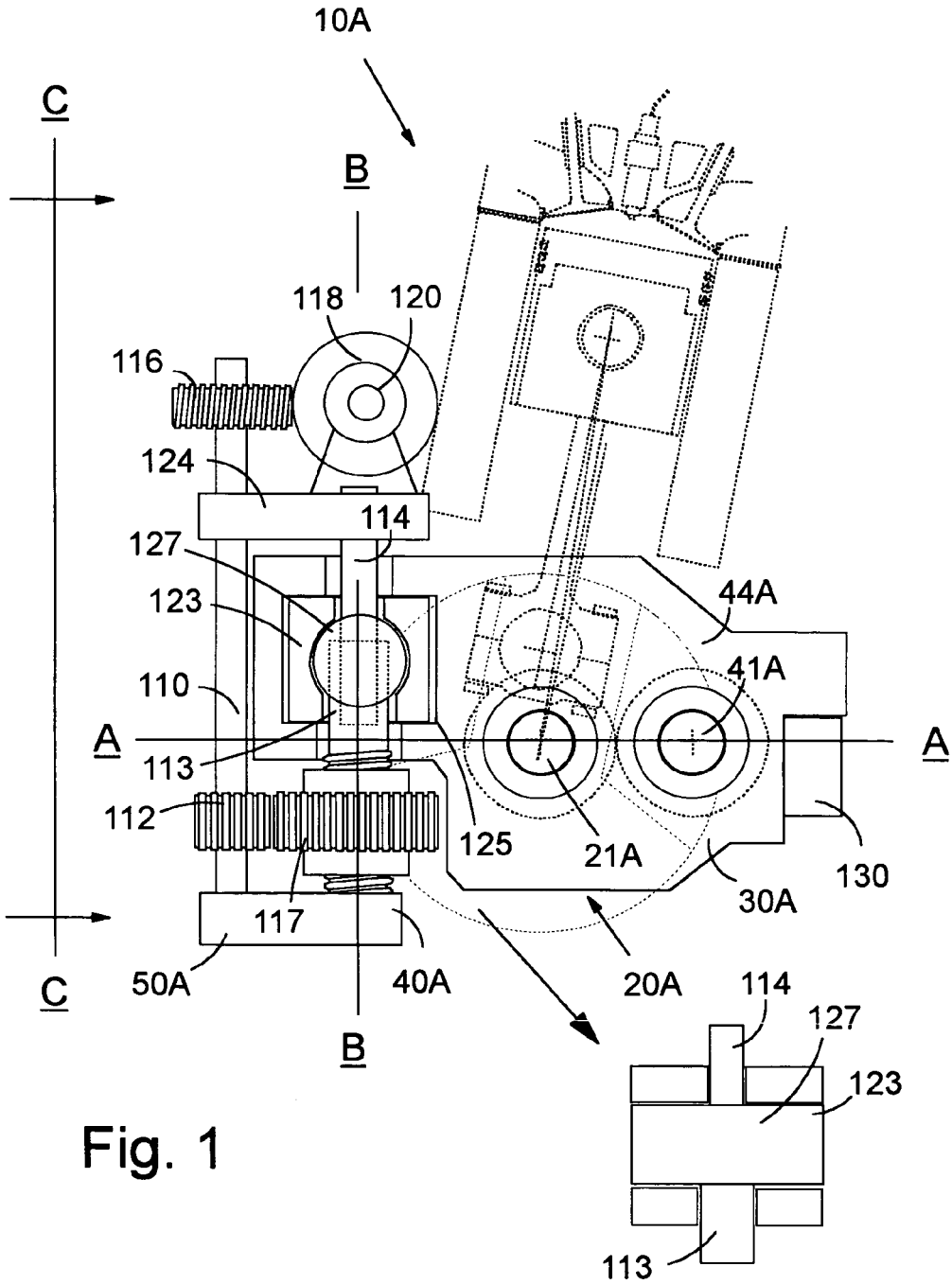
FIG. 1 is a cross-sectional view of an engine equipped with the VCR mechanism of the preferred embodiment with an emphasis on a jackscrew assembly and a crankshaft-driveshaft arm assembly taken along D—D of FIG. 2.
Figure 2:
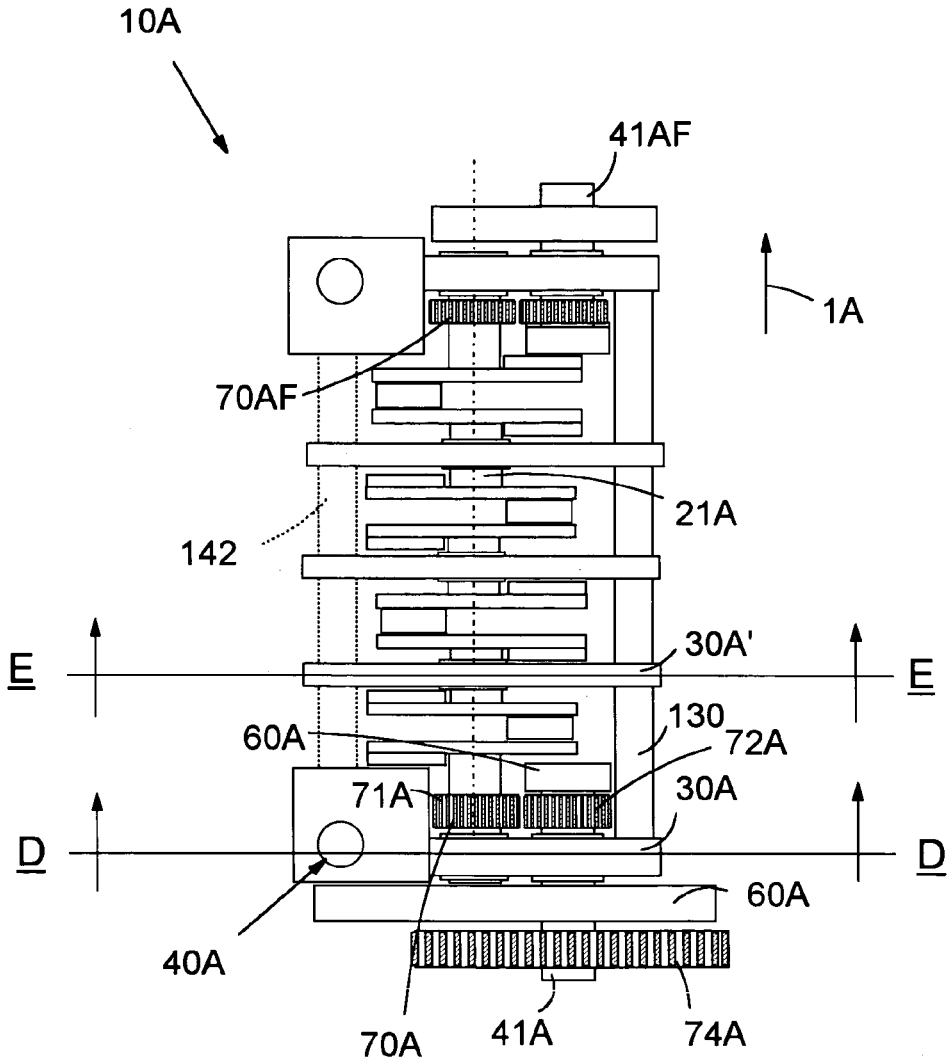
FIG. 2 is a cross-sectional view of the engine equipped with the jackscrew-based VCR mechanism taken along A—A of FIG. 1.

FIG. 1 is a cross-sectional view of an engine 10A equipped with a VCR mechanism of the preferred embodiment taken along D—D of FIG. 2. The engine 10A has a cylinder block with at least one group of bores, and each row of cylinder bores is longitudinally in line, and has at least one cylinder. The engine 10A has a driveshaft 41A through which the engine's output is transmitted to the externally located transmission, and a crankshaft 21A, which functions generally in the same manner as the crankshaft of any reciprocating engine except that its output must be transmitted to the driveshaft. The rotational axes of the driveshaft 41A and the crankshaft 21A are parallel.

The VCR engine 10A of the preferred embodiment generally comprises two crankshaft-driveshaft arm assemblies 30A, a driveshaft 41A, at least one crankshaft support plate assembly 30A' (not shown in FIG. 1, but shown in FIG. 2), connecting beams 130, 142, and 122 (shown in FIG. 3), two jackscrew assemblies 40A, and at least one transmission assembly 70A. The crankshaft-driveshaft arm assembly 30A comprises an arm member 44A, to which a bearing that holds the crankshaft 21A, and another bearing that holds the driveshaft 41A are affixed. One set of the crankshaft-driveshaft assembly 30A and jackscrew assembly 40A is employed near the longitudinal front-end and another set near the rear-end of the crankshaft. (Here, the expression "front" or "rear" of the engine means the direction of the engine when the engine is loaded on a car in the traditional manner, not mounted in a sideway.) Thus, when the crankshaft is lifted or lowered, the crankshaft will only move around the driveshaft axis with a fixed radius that equals the distance between the crankshaft's rotational axis and the driveshaft's rotational axis. The jackscrew assembly 40A lifts the crankshaft up and down and thus changes the compression ratio.

The crankshaft-driveshaft arm assembly 30A comprises an arm member 44A, and the bearings affixed to the arm member 44A for the crankshaft 21A and the driveshaft 41A. The jackscrew assembly 40A is placed in the vertical position with its base plate 50A placed beneath the "handle," or the narrow portion of the arm member 44A. The jackscrew assembly comprises spindles and a frame, and a cube-shaped articulate support means 123 that includes a cylindrical-shaped pin 127 within the cube-shaped support means 123. The upper spindle 113 of the jackscrew assembly 40A is affixed to the cylindrical-shaped pin 127. The cube-shaped articulated support means 123 is slidably received by a hollow cubic internal space 125 of the arm member 44A. A cross-sectional view of the articulated support means 123 taken along B—B is shown in the lower right corner of FIG. 1. A shaft 114 that shares the axis with the spindle 113 is affixed to the pin 127, and extends vertically upward. The cubic inner space 125 and the cube-shaped support means 123 have an opening on the bottom for the spindle 113 of the jackscrew assembly 40A, and an opening on the top for the shaft 114. When the arm member 44A is lifted up or down, the articulated support means 123 allows the spindles of the jackscrew assembly extends in the vertical direction in this case all times. The jackscrew assembly 40A is driven by a gear 112 that is mounted on a shaft 110 and a gear 117 that is affixed to the frame of the jackscrew assembly. Both shafts 110 and 114 are supported by shaft support arm 124 at the top, and the jackscrew spindles and the shaft 110 are supported by a jackscrew base plate 50A at the bottom of the jackscrew assembly to ensure that the shaft 110 and the jackscrew spindles are always kept in a vertical position. The shaft support 124 and the jackscrew base plate 50A are affixed to the engine frame. A gear 116 is mounted on the shaft 110. The gear 116 meshes with a gear 118, which is mounted on a shaft 120.

Figure 3:
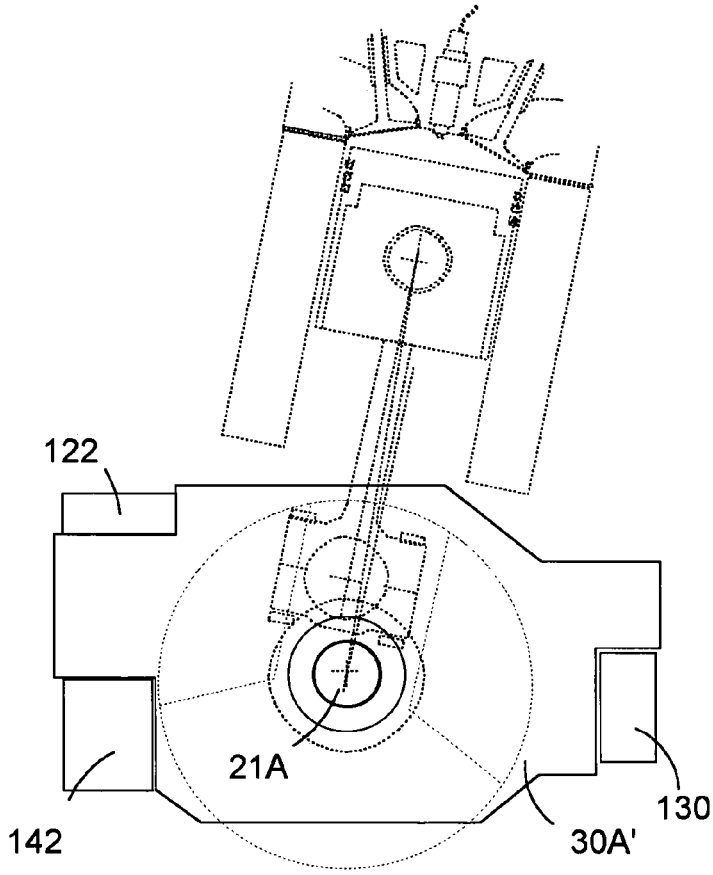
FIG. 3 is a cross-sectional view of the crankshaft-driveshaft arm assembly of the VCR mechanism taken along E—E of FIG. 2.

FIG. 2 is a cross-sectional view of the engine equipped with the jackscrew-based VCR mechanism taken along A—A of FIG. 1. The driveshaft 41A is generally located longitudinally at the rear end of the engine 10A, and is supported by the engine frame 60A. The arrow 1A indicates the front of the engine. The transmission assembly 70A that comprises a crankshaft gear 71A (affixed to the crankshaft 21A) and a driveshaft gear 72A (affixed to the driveshaft 41A) is placed between the crankshaft-driveshaft arm assembly 30A and the engine frame 60A. The engine utilizes two jackscrew assemblies 40A and two crankshaft-driveshaft assemblies 30A; i.e., one of each longitudinally generally at the front-end and the other of each generally at the rear-end of the engine. A crankshaft support plate assembly 30A' is installed beneath between every cylinder pair. These crankshaft-driveshaft arm assemblies and the crankshaft support plate assemblies are connected together by metal beams 130, 142, and 122 (not shown in FIG. 2, but shown in FIG. 3). The driveshaft 41A does not extend to the front end of the engine. The transmission assembly 70AF is mounted on the crankshaft 21A and the driveshaft extension 41AF longitudinally near the front end of the engine for the purpose of driving accessories. The flywheel 74A is affixed to the driveshaft 41A in the rear end of the engine. FIG. 3 shows a cross-sectional view of a crankshaft support plate assembly 30A' of the VCR mechanism shown in FIGS. 1 and 2 taken along E—E of FIG. 2.

Figure 4:
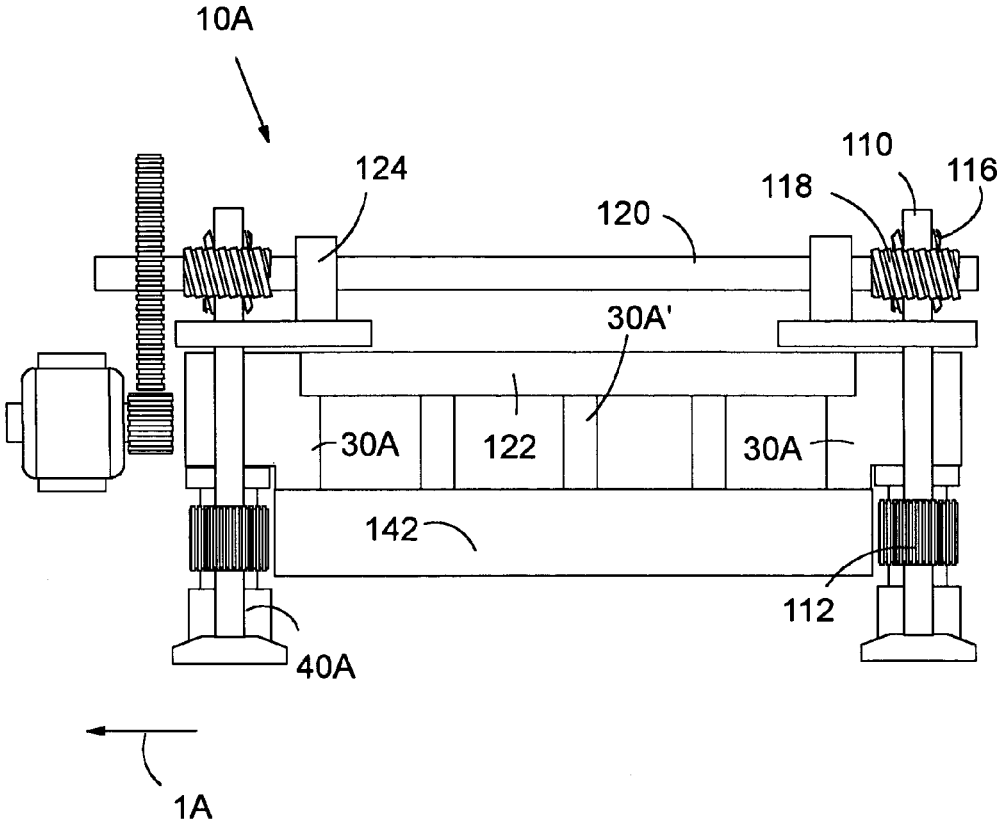
FIG. 4 is a side view of the engine equipped with the jackscrew-based VCR mechanism taken from C—C of FIG. 1.

FIG. 4 shows a side view of the engine 10A equipped with the jackscrew-based VCR mechanism taken from C—C of FIG. 1. The arrow 1A indicates the front of the engine. One set of jackscrew assembly 40A and a crankshaft-driveshaft arm assembly 30A is mounted longitudinally in front-end of the engine, and another identical set in the rear-end of the engine. A motor that drives the VCR mechanism is mounted in front-end (left side of FIG. 4) of the engine, and motor shaft is rotatably connected to a gear that is mounted on the shaft 120. The gear 118 mounted on the shaft 120 meshes with the gear 116 mounted on the shaft 110. The gear 112 mounted on the shaft 110 drives the jackscrew assembly. The beams 122 and 142 that are affixed to the crankshaft-driveshaft assemblies 30A at longitudinally near front and rear ends of the engine support the crankshaft support plates 30A'. The objective of the use of these beams and the use of the crankshaft support plates beneath between every piston pair is to ensure rigid and strong enough structure of the engine.

Figure 5:
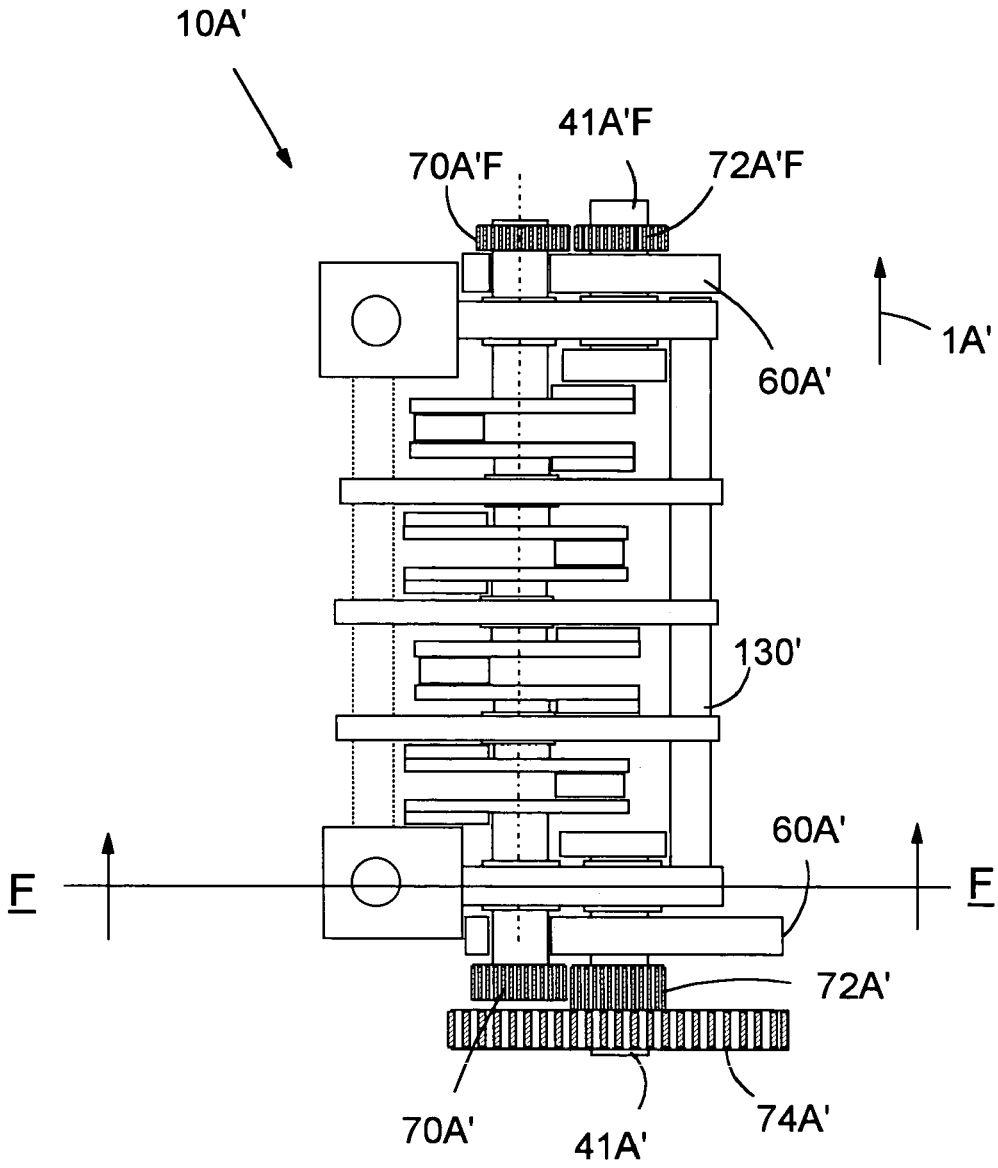
FIG. 5 is a cross-sectional view of an alternative design of the engine equipped with the jackscrew-based VCR mechanism.

FIG. 5 shows a cross-sectional view of an alternative design of the engine equipped with the jackscrew-based VCR mechanism. This alternative design 10A' uses the identical jackscrew assembly and crankshaft-driveshaft arm assembly designs shown in FIGS. 1 through 4. In this design, the gear 72A' of the transmission assembly 70A' (mounted near the rear-end of the engine), and the gear 72A'F of the transmission assembly 70A'F (mounted near the front end of the engine), are rotatably but not slidably mounted on the driveshaft 41A' and 41A'F respectively. The arrow 1A' indicates the front of the engine. The flywheel 74A' is affixed to the gear 72A' and pulleys that drive accessories are affixed to the gear 72A'F.

Figure 6:
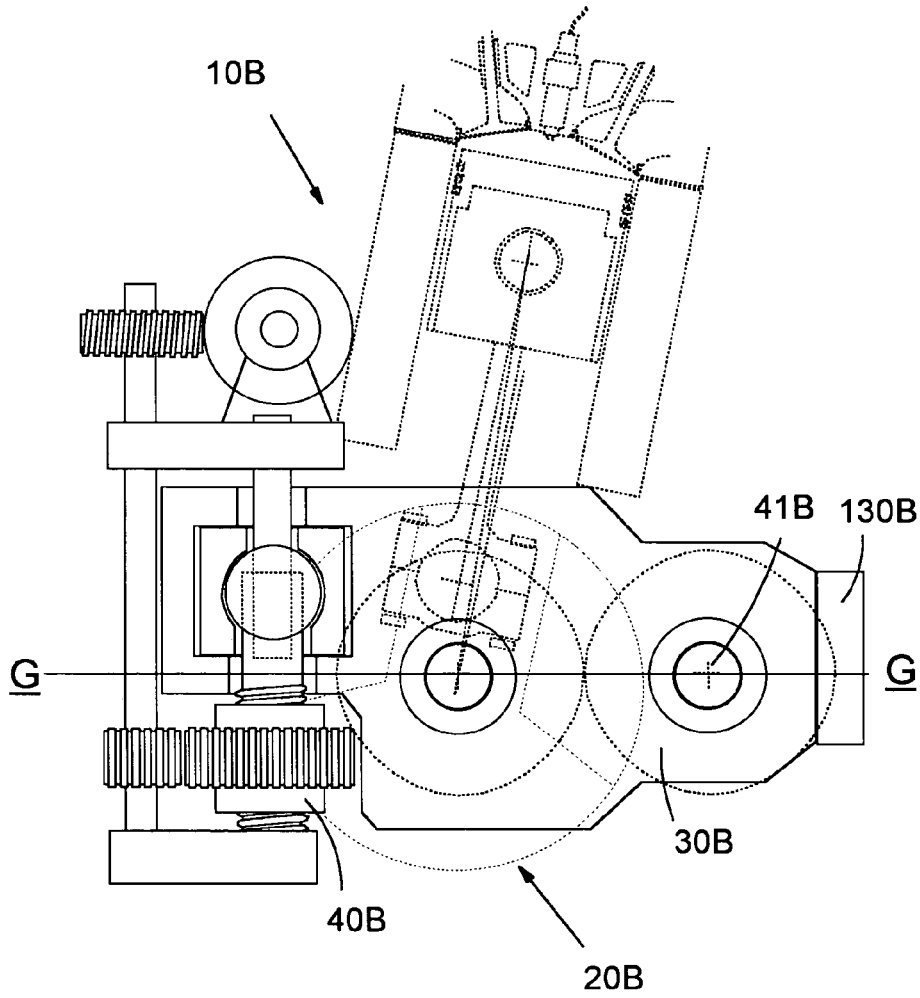
FIG. 6 is a cross-sectional view of a crankshaft-driveshaft arm assembly of an alternative jackscrew-based VCR mechanism taken along H—H of FIG. 7.
Figure 7:
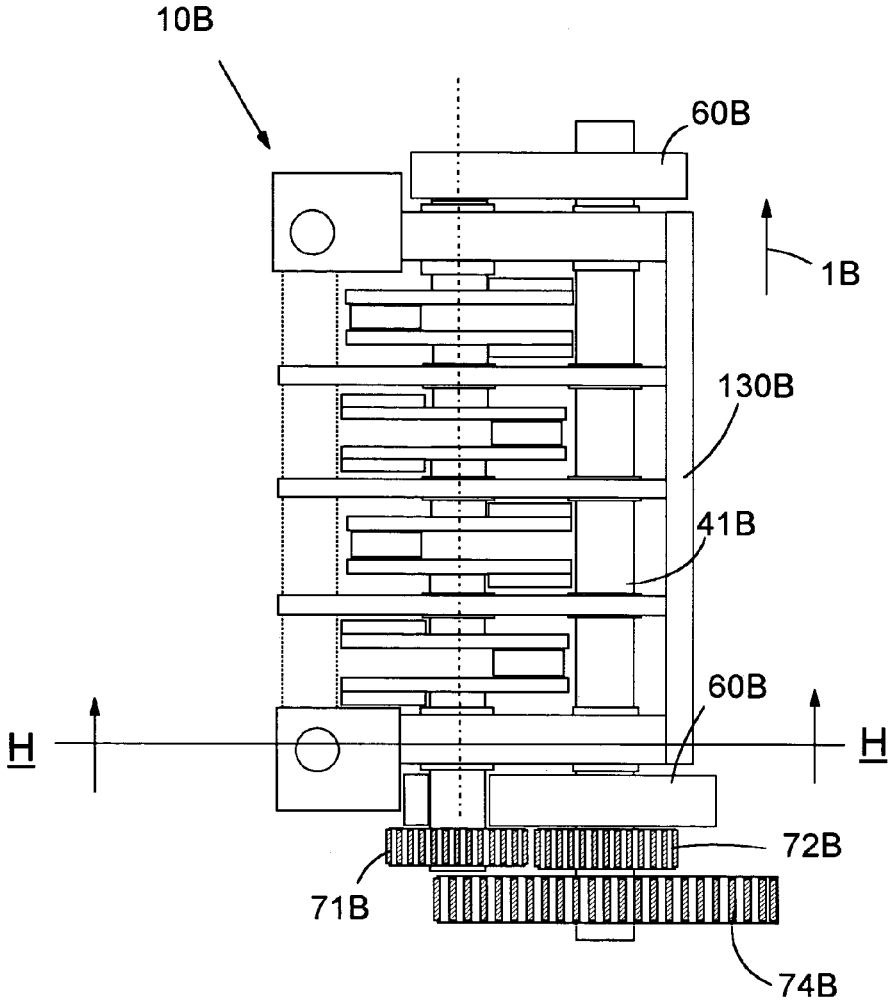
FIG. 7 is a cross-sectional view of the engine equipped with the jackscrew-based VCR mechanism taken along G—G of FIG. 6.

FIG. 6 shows a cross-sectional view of an engine 10B emphasizing the crankshaft-driveshaft arm assembly 30B and the jackscrew assembly 40B of another jackscrew-based VCR mechanism taken along H—H of FIG. 7, and FIG. 7 is a cross-sectional view of the engine 10B taken along G—G of FIG. 6. In this design, the driveshaft 41B extends to the front end of the engine. This means that a crankshaft-driveshaft arm assembly instead of a crankshaft support assembly is placed beneath between each pair of the pistons; that a transmission assembly is not required in front-end of the engine; and that the driveshaft 41B is supported at two points (near the front and rear end) of the engine frame 60B. The arrow 1B in FIG. 7 indicates the front of the engine. The driveshaft 41B rotatably supports all the crankshaft-driveshaft arm assembly, but in order to increase the rigidity of the crankshaft support system of the engine, the beam 130B is used also. The gear 71B and the gear 72B are affixed to the crankshaft and the driveshaft, respectively. The flywheel 74B is affixed to the driveshaft.

Figure 8:
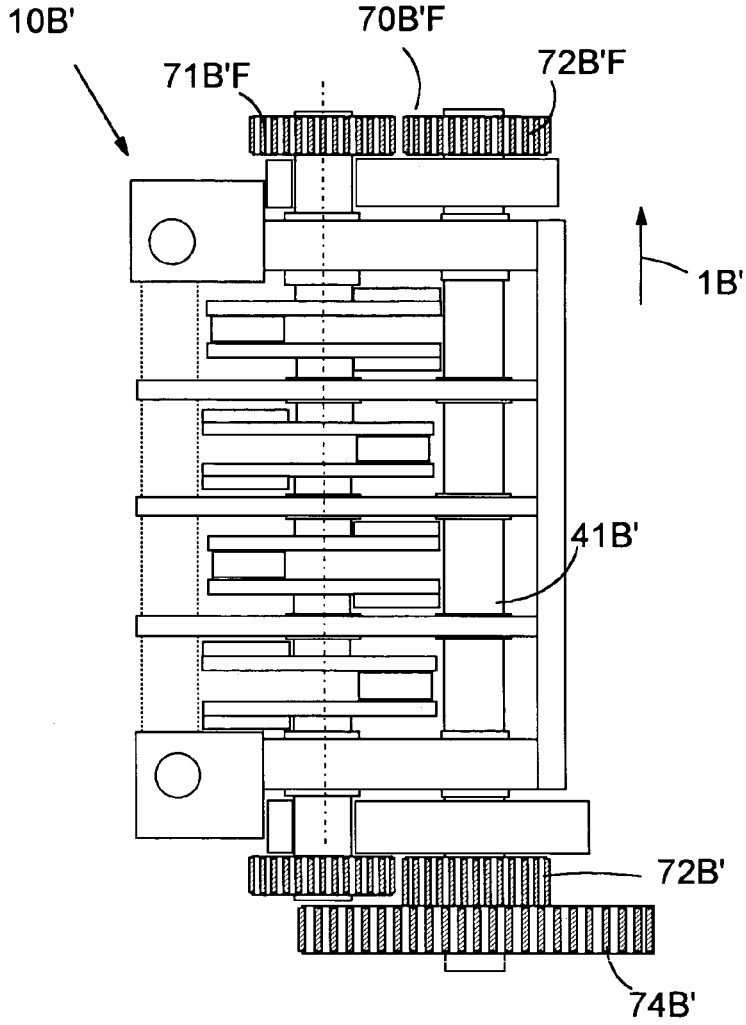
FIG. 8 is a cross-sectional view of an alternative design of the engine equipped with the jackscrew-based VCR mechanism shown in FIG. 6 taken along G—G of FIG. 6.

FIG. 8 shows a cross-sectional view of an alternative design 10B' of the engine equipped with the jackscrew-based VCR mechanism shown in FIG. 6 taken along G—G of FIG. 6. In this design, the gear 72B' is rotatably but not slidably mounted on the driveshaft gear 41B'; the flywheel 74B' is affixed to the gear 72B'; another transmission assembly 70B'F is mounted on the crankshaft and driveshaft; another transmission assembly 70B'F is mounted on the crankshaft and driveshaft; and pulleys that drive accessories are affixed to the gear 72B'F.

Figure 9:
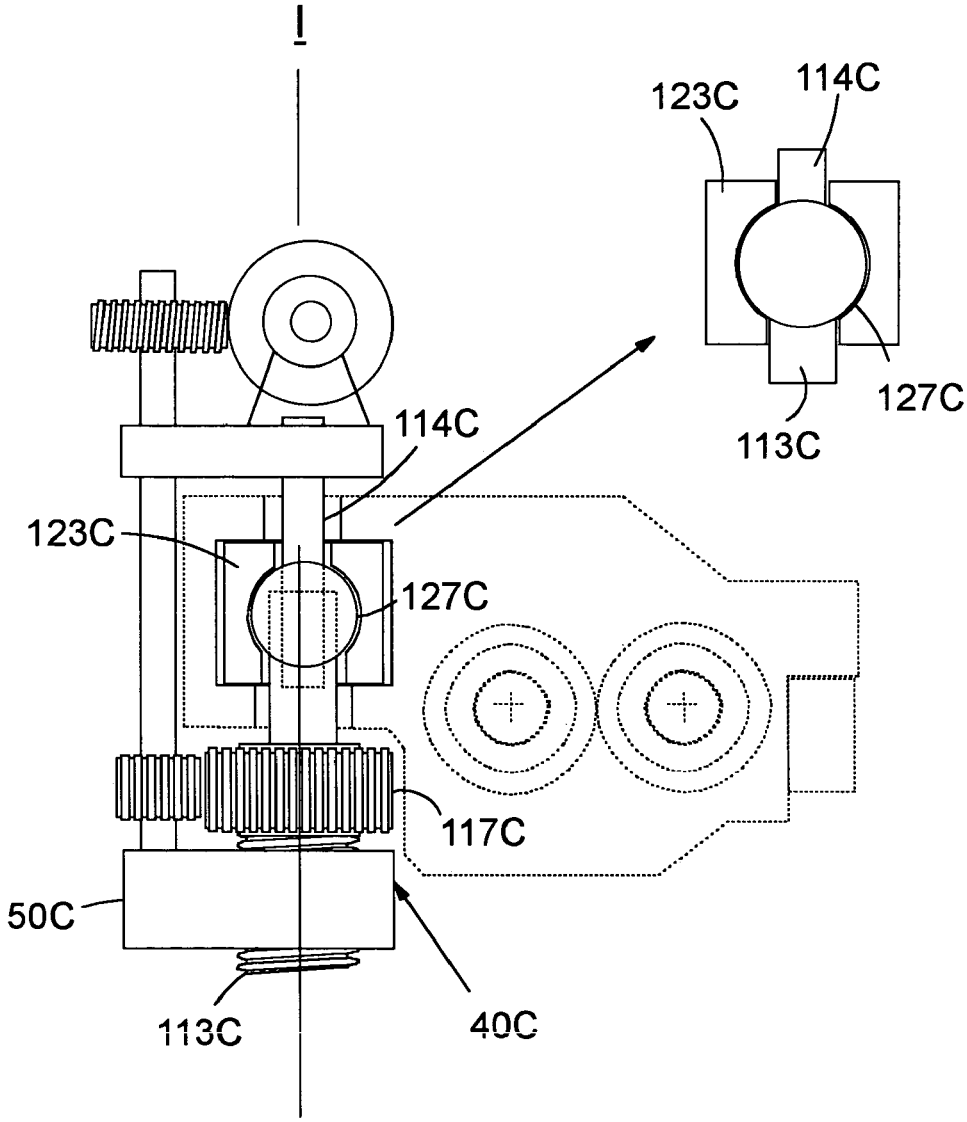
FIG. 9 is an alternative design of the jackscrew assembly 40C.

FIG. 9 shows another alternative design of the jackscrew assembly 40C. In this alternative design, a metal piece that functions as the pin 127C housed in the articulated support means 123C is sphere shaped; The base plate 50C of the jackscrew assembly 40C has a cylindrical hole with a wall with a thread, and meshes with the spindle 113C. A gear 117C is affixed to the spindle 113C. The spindle 113C, the sphere-shaped pin, and the shaft 114C rotate together as the jackscrew assembly 40C operates. A cross-sectional view of the articulated support means 123C taken along I—I is shown in the upper right corner of FIG. 9.

Figure 10:
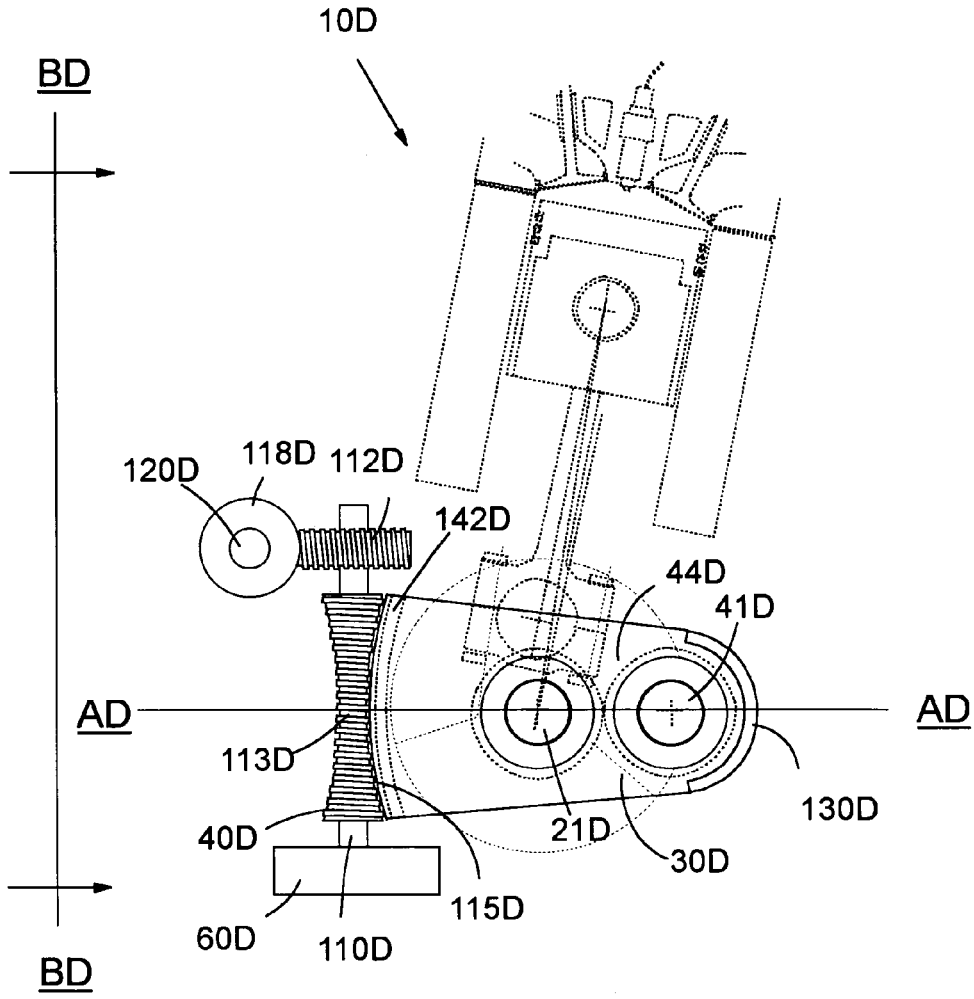
FIG. 10 is a cross-sectional view of an engine equipped with the VCR mechanism of an alternative embodiment with an emphasis on a means to lift the crankshaft up and down and a crankshaft-driveshaft arm assembly taken along CD—CD of FIG. 11.
Figure 11:
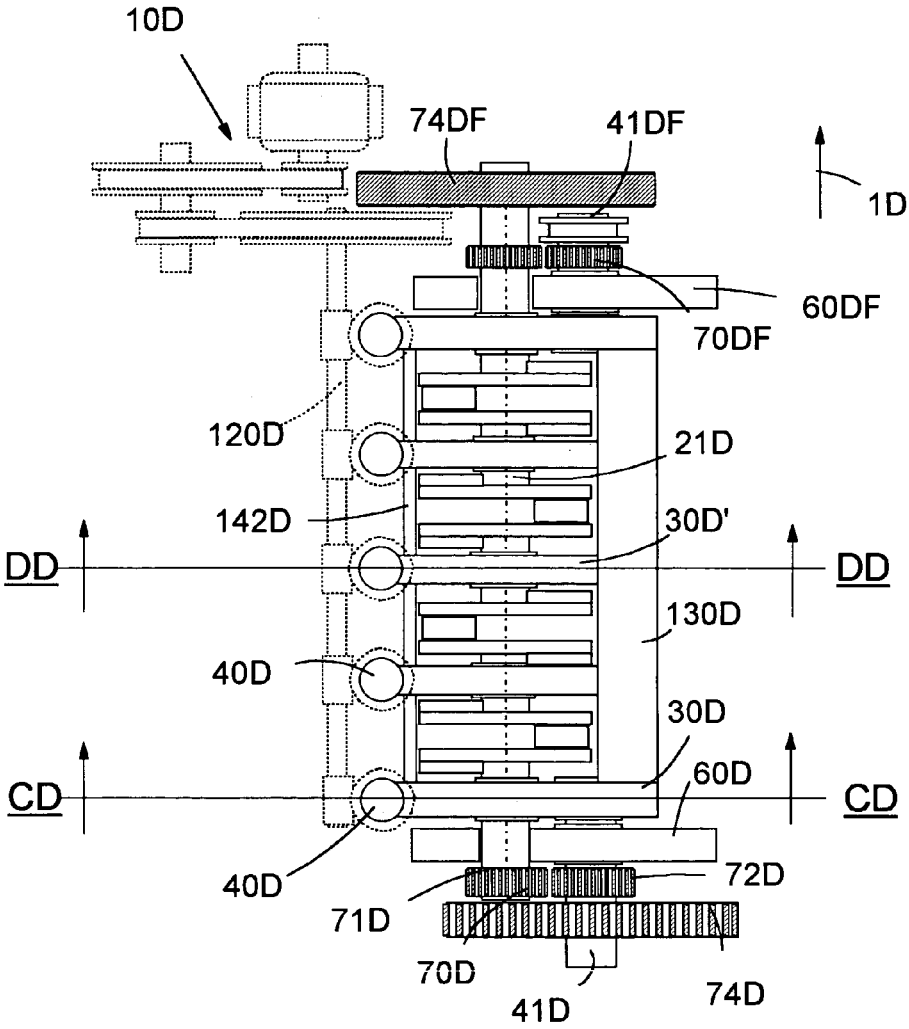
FIG. 11 is a cross-sectional view of the engine equipped with a worm-gear set-based VCR mechanism taken along AD—AD of FIG. 10.

FIG. 10 is a cross-sectional view of an engine 10D equipped with a VCR mechanism of another alternative design taken along CD—CD of FIG. 11. The engine 10E has a cylinder block with at least one group of bores, and each row of cylinder bores is longitudinally in line, and has at least one cylinder. The engine 10D has a driveshaft 41D through which the engine's output is transmitted to the externally located transmission, and a crankshaft 21D, which functions generally in the same manner as the crankshaft of any reciprocating engine except that its output must be transmitted to the driveshaft. The rotational axes of the driveshaft 41D and the crankshaft 21D are parallel.

The VCR mechanism of this alternative embodiment generally comprises two crankshaft-driveshaft arm assemblies 30D, a driveshaft 41D, at least one crankshaft support plate assembly 30D', at least two worm gear assemblies 40D, at least one transmission assembly 70D, and connecting metal plates. The crankshaft-driveshaft arm assembly 30D comprises an arm member 44D, a bearing that holds the crankshaft 21D, and another bearing that holds the driveshaft 41D. One set of the crankshaft-driveshaft assembly 30D and the worm gear assembly 40D is employed near the longitudinal front-end, and another set near the rear-end of the crankshaft. Thus, when the crankshaft is lifted or lowered, the crankshaft will only move around the driveshaft axis with a fixed radius that equals the distance between the crankshaft's rotational axis and the driveshaft's rotational axis (see FIG. 11 also).

The worm gear assembly 40D, which comprises the worm 113D of a worm gear set and a shaft 117D, lifts the crankshaft up and down and thus changes the compression ratio. The pitch diameter of the worm 113D varies. The pitch diameters of the worm 113D at the top and the bottom of the worm are larger than the pitch diameter of the worm at the mid-section. Usual worm of a worm gear set has a constant pitch diameter. But, the worm of a constant pitch diameter will limit the number of teeth meshing together at a time to a few teeth. The worm 113D of a varying pitch diameter increases the number of meshing gear teeth at a time.

The crankshaft-driveshaft arm assembly 30D comprises an arm member 44D, and the bearings affixed to the arm member 44D for the crankshaft 21D and the driveshaft 41D. A partial cylindrical surface of the arm member 44D has teeth and functions as the worm gear 115D of the worm gear set, and the worm 113D is a part of the worm gear assembly 40D. Even though the worm gear assembly does not include the worm gear, it is called as such only for convenience. The worm gear assembly 40D is driven by a gear 112D that is mounted on a shaft 110D. The shaft 110D is supported by the engine frame. The gear 112D meshes with gear 118D, which is mounted on a shaft 120D.

FIG. 11 is a cross-sectional view of the engine equipped with the worm gear assembly-based VCR mechanism taken along AD—AD of FIG. 10. The driveshaft 41AD is generally located longitudinally at the rear end of the engine 10D, and is supported by the engine frame 60D. The arrow 1D indicates the front-of the engine. The transmission assembly 70D that comprises a crankshaft gear 71D (affixed to the crankshaft 21D) and a driveshaft gear 72D (affixed to the driveshaft 41D) is placed at the rear end of the engine outside the engine frame 60D.

A crankshaft support plate assembly 30D' is located beneath between every cylinder pair. The crankshaft-driveshaft arm assemblies and the crankshaft support plate assemblies are connected together by a partial cylindrical shaped metal plate 130D, and partial cylindrical shaped metal plates 142D. The driveshaft 41D does not extend to the front end of the engine. Another transmission assembly 7ODF is mounted on the crankshaft 21D and the driveshaft extension 41DF longitudinally near the front end of the engine for the purpose of driving accessories, etc. A flywheel 74DF is affixed to the crankshaft 21D in the front end of the engine. Another flywheel 74D may be affixed to the driveshaft 41D.

Figure 12:
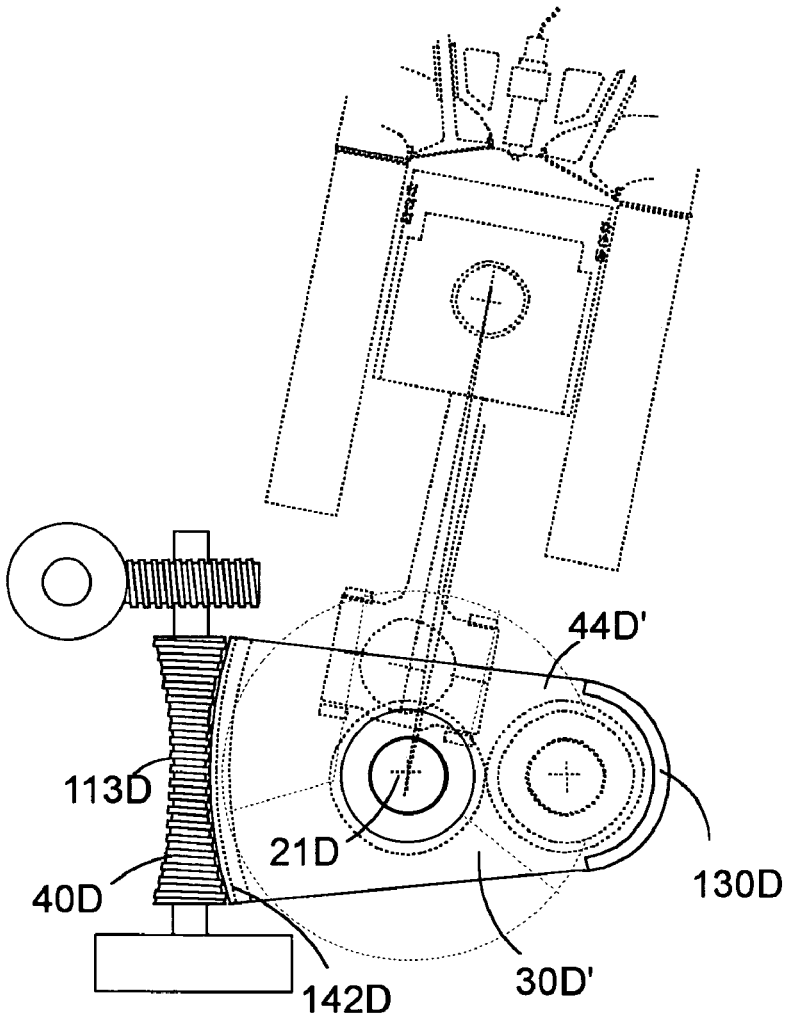
FIG. 12 is a cross-sectional view of the crankshaft-driveshaft arm assembly of the VCR mechanism taken along DD—DD of FIG. 2.

FIG. 12 shows a cross-sectional view of a crankshaft-support plate assembly 30D' of the VCR mechanism shown in FIGS. 10 and 11 taken along DA—DA of FIG. 11. The crankshaft support plate assembly 30A' is identical to the crankshaft-driveshaft arm assembly 30D except that the crankshaft support plate assembly does not have the bearing for the driveshaft 41D. Just as with the crankshaft-driveshaft arm assembly 30D, the partial cylindrical surface of the arm member 44D' of the crankshaft support plate assemblies 30D' has gear teeth, and the arm member 44D' functions as worm gear of a worm gear set, in which the worm gear meshes with the worm 113D of the worm gear assembly 40D.

Figure 13:
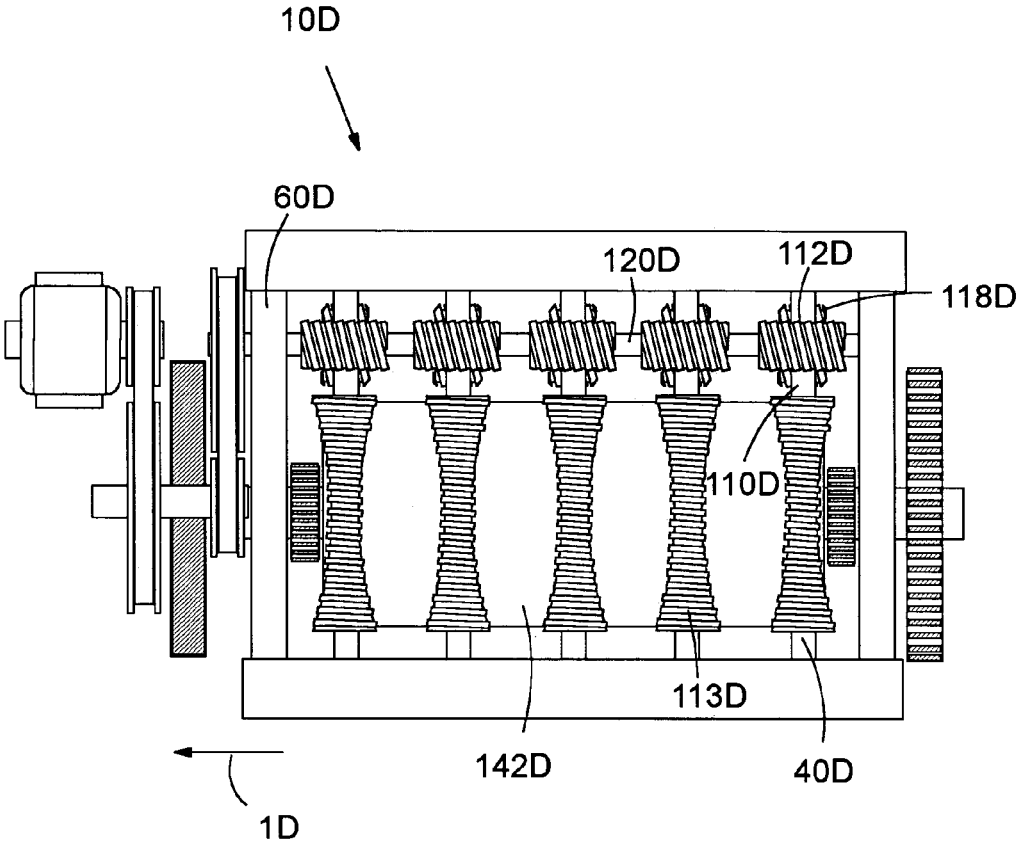
FIG. 13 is a side view of the engine equipped with the worm-gear-based VCR mechanism taken from BD—BD of FIG. 11.

FIG. 13 shows a side view of the engine 10D equipped with the worm gear-based VCR mechanism taken from BD—BD of FIG. 10. The arrow 1D indicates the front of the engine. As described earlier, one set of a worm gear assembly 40D and a crankshaft-driveshaft arm assembly 30D is installed longitudinally in the front-end of the engine, and another identical set in the rear-end of the engine, and one set of a worm gear assembly 40D and a crankshaft support assembly 30D' is installed below between each piston pair. The metal plates 142D (and the metal plate 130D, which is not shown in FIG. 13) connect the crankshaft-driveshaft assemblies 30D and crankshaft support plate assemblies 30D' to ensure the structural integrity of the engine. A motor that drives the VCR mechanism is installed in front-end (left side of FIG. 13) of the engine 10D, and motor shaft is rotatably connected to a gear that is mounted on the shaft 120D. The gear 118D mounted on the shaft 120D meshes with the gear 112D mounted on the shaft 110D. The shafts 110D and 120D are affixed to the engine frame.

Figure 14:
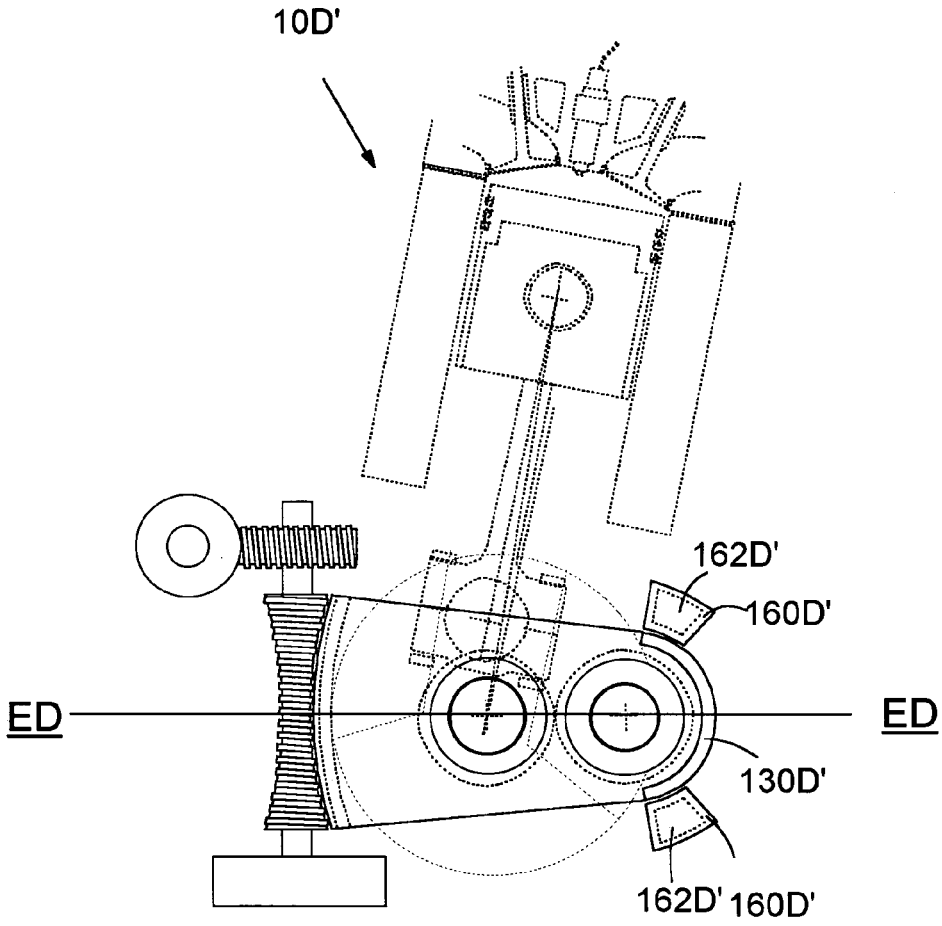
FIG. 14 is a cross-sectional view of an alternative design of the engine equipped with the worm-gear set-based VCR mechanism taken along FD—FD of FIG. 15.
Figure 15:
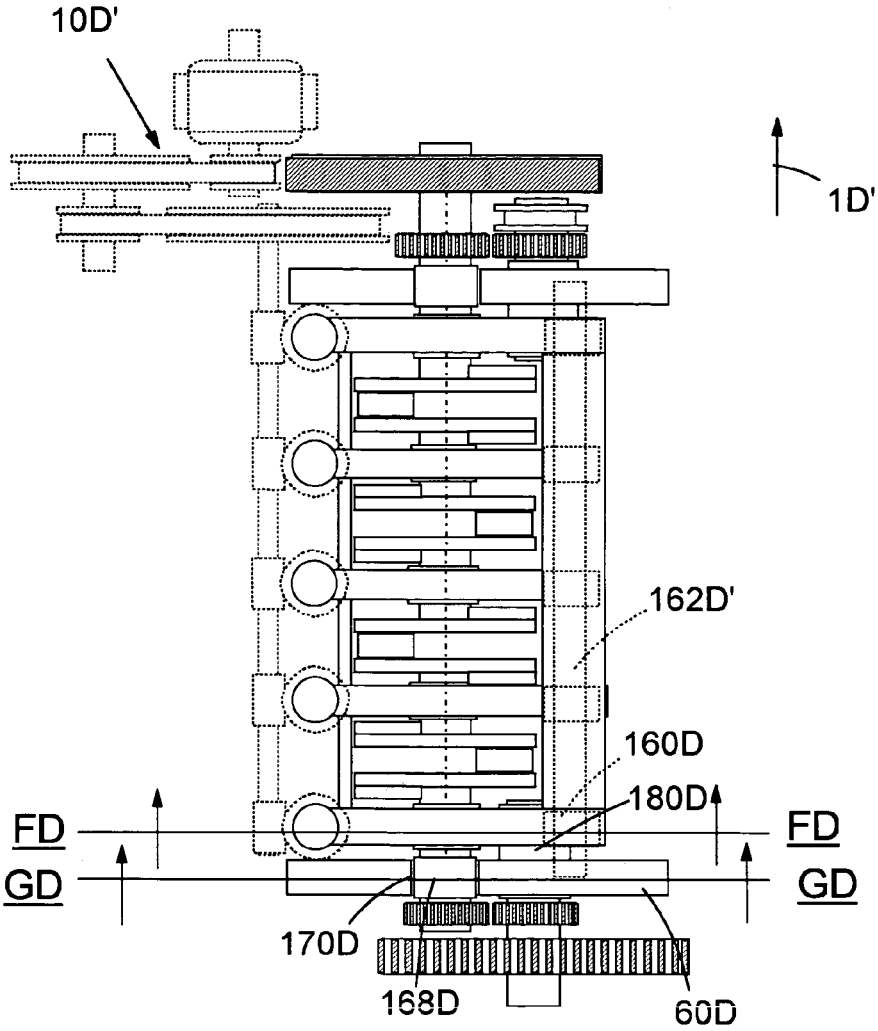
FIG. 15 is a cross-sectional view of an alternative design of the engine equipped with the worm-gear set-based VCR mechanism taken along ED—ED of FIG. 14.

FIG. 14 shows a cross-sectional view of an alternative design of the engine equipped with the worm gear-based VCR mechanism taken along FD—FD of FIG. 15. This alternative design 10D' uses identical VCR mechanism shown in FIGS. 10 through 13. This design is equipped with additional means to reinforce structural integrity of the VCR mechanism. The additional means comprises metal members 160D', and metal beams 162D' that connect the metal members 160D' and the engine frame. The outer surface of the metal plate 130D' is partial cylindrical shaped and shares the axis with the rotational axis of the driveshaft 41D. The inner surfaces of the metal members 160D' are also partial cylindrical shaped, and share the axis with the rotational axis of the driveshaft 41D (see FIGS. 10 and 11), and in contact with the outer partial cylindrical surface of the metal plate 130D'. The metal plate 130D' and the metal member 160' together support a portion of vertical force generated by the engine. FIG. 15 is a cross-sectional view of the alternative design taken along ED—ED of FIG. 14. In an alternative design, at least one of the metal members 160 is affixed to the engine frame.

Figure 16:
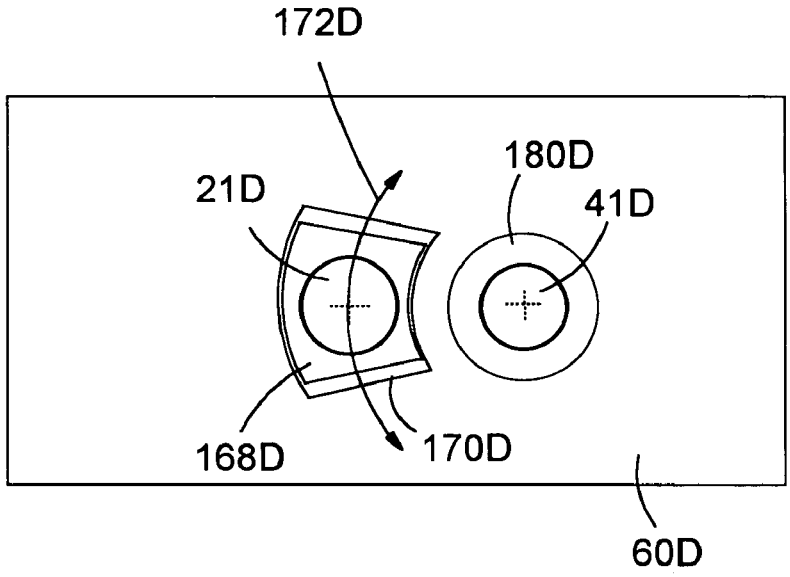
FIG. 16 is a cross-sectional view of the engine frame taken along GD—GD of FIG. 15.

FIG. 16 is a cross-sectional view of the engine frame 60D taken along GD—GD of FIG. 15. The crankshaft 21D moves up and down in the direction of an arrow 172D around the axis of the crankshaft 41D. The lateral cross-section of crankshaft bearing 168D is shaped like a warped rectangle, wherein two of the sides are circular arc-shaped, and the center of these circular is the rotational axis of the driveshaft axis. The crankshaft bearing 168D moves up and down together with the crankshaft 21D. An opening 170D of the engine frame with four sides and two of which with circular arc-shaped lateral cross-sections, functions as a bearing of the crankshaft bearing 168D. There is another opening in the engine frame 60D for the driveshaft bearing 180D. The sides of the crankshaft bearing 168D are constantly in contact with the sides of the opening 170D of the engine's frame 60D and support partial horizontal force of the force produced by the engine. The driveshaft bearing 180D is supported by the crankshaft-driveshaft arm assembly 30D and the engine frame 60D.

Figure 17:
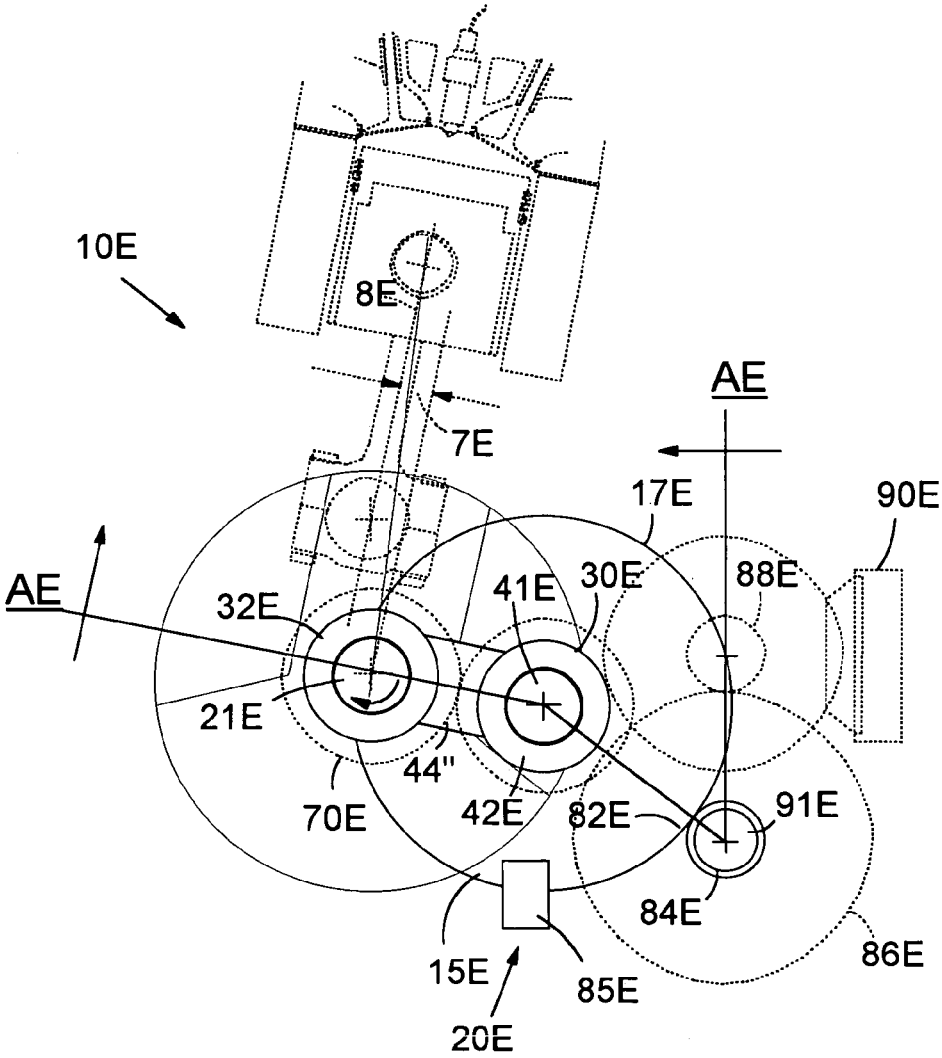
FIG. 17 is a cross-sectional view of an engine with a spur-gear-based VCR mechanism of an alternative design emphasizing an arm-lifting gear assembly taken along BE—BE of FIG. 18.
Figure 18:
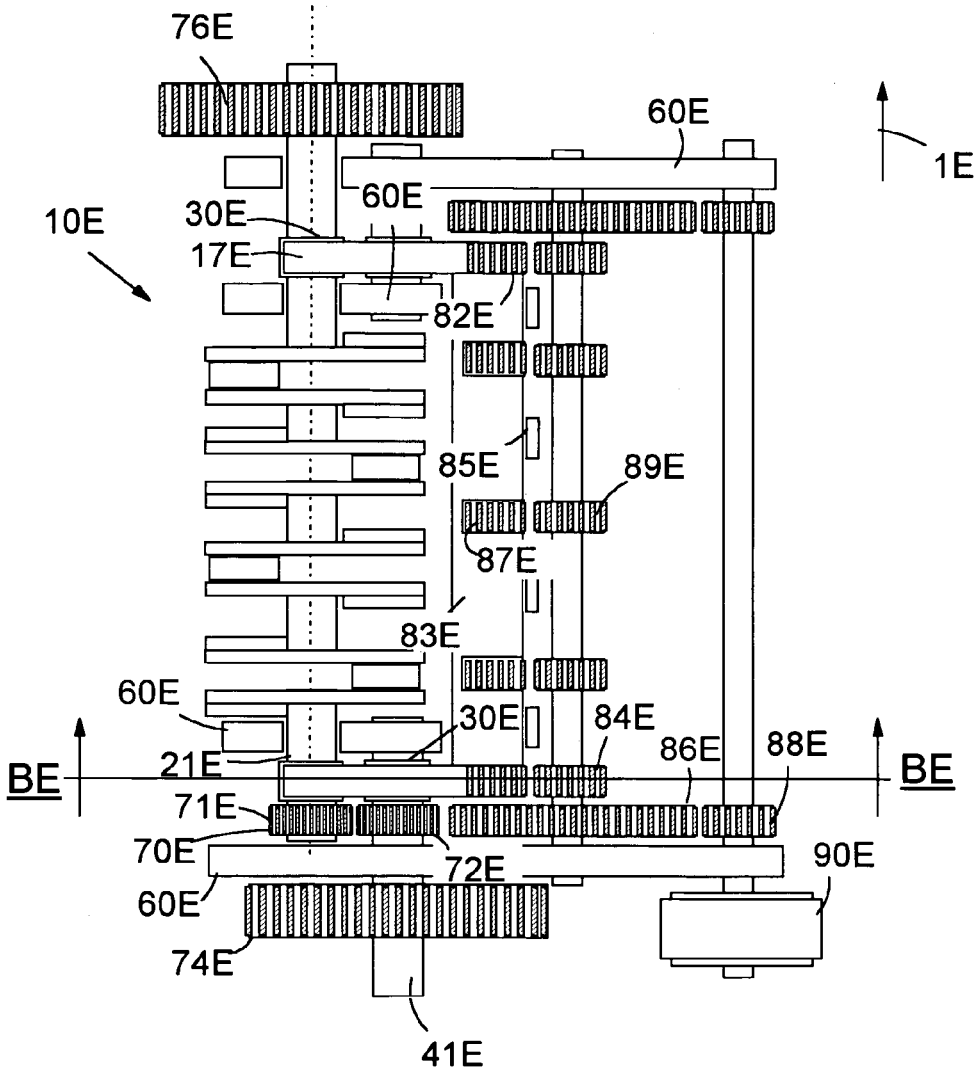
FIG. 18 is a cross-sectional view of the engine equipped with the spur-gear-based VCR mechanism of the alternative design taken along AE—AE of FIG. 17.

FIG. 17 is a cross-sectional view of an engine 10E of an in-line cylinder arrangement with the VCR mechanism 10E emphasizing the arm-lifting gear assembly 15E taken along BE—BE of FIG. 18. The arm-lifting gear assembly 15E comprises partially disc-shaped metal plate 17E with its cylindrical outer convex surface with partially outfitted with gear teeth 82E affixed to the crankshaft-driveshaft arm assembly 30E, a gear 84E affixed to a shaft 91E that is parallel to the driveshaft, another gear 86E affixed to the shaft 91E, and a locking device 85E. The metal plate 17E is affixed to the crankshaft-driveshaft arm assembly 30E, which swings around the driveshaft 41E. The gear teeth 82E mesh with the gear 84E. The gear 84E is rotatably connected to the motor shaft of a motor 88E through the gear 86E. Thus, the rotation of the motor shaft 88E causes the lifting or lowering the crankshaft 21E.

FIG. 18 is a cross-sectional view of the engine 10E equipped with the arm-lifting gear-based VCR mechanism of the alternative design taken along AE—AE of FIG. 17. The arm-lifting gear assembly 15E includes a pair of partially disc-shaped metal plates 17E with cylindrical outer convex surfaces partially outfitted with gear teeth 82E; a partially cylindrical metal plate 83E affixed to the rim of the metal plates 17E at the longitudinal ends; a gear 84E affixed to a shaft 91E that is parallel to the driveshaft; and another gear 86E affixed to the shaft 91E, and a locking device 85E. The metal plate 17E is affixed to the crankshaft-driveshaft arm assembly 30E, which swings around the driveshaft 41E. At least one set of gear teeth 87E of the same tooth size and the same pitch circle radius as the discs with gear teeth 82E are affixed on the outer convex surface of the partially cylindrical metal plate 83E. The gear teeth 82E mesh with the gear 84E that is affixed to a shaft 91E that is parallel to the driveshaft 41E. The sets of gear teeth 87E mesh with gears 89E, which have the same pitch circle and tooth size as the gears 84E, and are affixed to the shaft 91E. The gear 84E is rotatably connected to the motor shaft of the motor 90E through the gear 86E, which is affixed to the shaft 91E. Thus, the rotation of the motor shaft 88E causes the lifting lowering of the crankshaft. The motor shaft has a locking mechanism 85E that locks the gear position.

In operation, an onboard computer equipped with necessary memory and software (1) measures the current operational conditions and the relative height D of the top or bottom surface of the crankshaft from an arbitrary point, (2) receives a desired height D or an estimated desired height D, and (3) varies the height D from current level to the desired level. In addition, the computer is connected to the knocking sensor, and if knocking is detected, then the computer will immediately lower the height D. The driver should have a choice of manually selecting high or low torque mode. The on-board computer that controls the VCR mechanism would then respond to the driver's request by adjusting the compression ratio accordingly.

The invention having been described in detail in accordance with the requirements of the U.S. Patent Statutes, various other changes and modifications will suggest themselves to those skilled in this art. For example, the number of jackscrew units used is not limited to two. A flywheel may be affixed to either the crankshaft or the driveshaft, or may be affixed to the crankshaft inside the engine frame. Pneumatic pistons and a cylinder with oil pressure may be used as a means to power the jackscrew and the gear set. Two different means to lift the crankshaft up and down; e.g., a jackscrew assembly and a arm-lifting gear assembly, may be used in one engine. It is intended that the above and other such changes and modifications shall fall within the spirit and scope of the invention defined in the appended claims.

I claim:

1. An internal combustion engine having a variable compression ratio including a crankshaft, a driveshaft, at least one crankshaft-driveshaft arm assembly, a transmission assembly, and a means to lift up and down said crankshaft, wherein said crankshaft being parallel to said driveshaft, said crankshaft-driveshaft arm assembly having an arm member, and first and second bearings, said first and second bearings of said crankshaft-driveshaft arm assembly affixed to said arm member, said first bearing rotatably receiving said crankshaft and said second bearing rotatably receiving said driveshaft, and said transmission assembly having first and second gears wherein said first gear is affixed to said crankshaft, and said second gear affixed to said driveshaft.

2. An internal combustion engine as defined in claim 1 wherein said means to lift up and down said crankshaft includes at least one jackscrew assembly.

3. An internal combustion engine as defined in claim 1 wherein said jackscrew assembly having at least one spindle, and an articulated support means.

4. An internal combustion engine as defined in claim 3 wherein said crankshaft-driveshaft arm assemblies being connected together by metal beams.

5. An internal combustion engine as defined in claim 3 wherein said transmission assembly having first and second gears wherein said first gear is affixed to said crankshaft, and said second gear affixed to said driveshaft, and said first and second gears mesh together.

6. An internal combustion engine as defined in claim 1 wherein said means to lift up and down said crankshaft includes at least one arm-lifting gear assembly, wherein said arm-lifting gear assembly includes a first gear and second gear, and a shaft parallel to said driveshaft wherein said first gear with partially outfitted with teeth affixed to said crankshaft-driveshaft arm assembly, said second gear rotatably mounted on said shaft parallel to said drive shaft, and said first and second gears mesh together.

7. An internal combustion engine as defined in claim 6 wherein said internal combustion engine having first crankshaft-driveshaft assembly and second crankshaft-driveshaft assembly, said arm-lifting gear assembly having a partially cylindrical metal piece with an outer convex surface, said partially cylindrical metal piece affixed to said first crankshaft-driveshaft assembly at one longitudinal end, said metal piece affixed to said second crankshaft-driveshaft assembly at the other longitudinal end, said partially cylindrical metal piece having at least two sets of gear teeth of said first gear on said outer convex surface, said second gears rotatably mounted on said shaft parallel to said drive shaft, and said first and second gears mesh together.

8. An internal combustion engine having a variable compression ratio including a crankshaft, a driveshaft, at least one crankshaft-driveshaft arm assembly, at least one transmission assembly, wherein said crankshaft being parallel to said driveshaft, said crankshaft being rotatably connected to said piston by said connecting rod, said crankshaft-driveshaft arm assembly having an arm member, and first and second bearings, said first and second bearings of said crankshaft-driveshaft arm assembly affixed to said arm member, said first bearing rotatably receiving said crankshaft and said second bearing rotatably receiving said driveshaft, said crankshaft support plate assembly having an arm member, and a bearing, said bearing of said crankshaft support plate assembly affixed to said arm member, said crankshaft-driveshaft arm assemblies and said crankshaft support plate assemblies being connected together by said connecting metal plates, said arm member of said crankshaft-driveshaft arm assembly having a partial cylindrical surface, said partial cylindrical surface of said crankshaft-driveshaft arm assembly having worm gear teeth, said arm member of said crankshaft support plate assembly having a partial cylindrical surface, said partial cylindrical surface of said crankshaft support plate assembly having worm gear teeth, said worm gear assembly having a worm and a shaft, said worm of said worm gear assembly and partial cylindrical surface of said arm member of said crankshaft-driveshaft arm assembly form a worm gear set, said worm of said worm gear assembly and partial cylindrical surface of said arm member of said crankshaft support plate assembly form a worm gear set, and said worm has a larger pitch diameter at two ends than at mid-section.

9. An internal combustion engine as defined in claim 8 wherein said transmission assembly having first and second gears wherein said first gear is affixed to said crankshaft, and said second gear affixed to said driveshaft, and said first and second gears mesh together.

* * * * *